United States Patent [19]

Crews

[11] Patent Number: 4,999,864

[45] Date of Patent: Mar. 19, 1991

[54] BED MOVABLE TO PLURAL POSITIONS

[76] Inventor: Paul B. Crews, 2300 Telequana, Anchorage, Ak. 99517

[21] Appl. No.: 506,212

[22] Filed: Apr. 9, 1990

[51] Int. Cl.[5] ..... A47C 19/20

[52] U.S. Cl. ..... 5/131; 5/9.1

[58] Field of Search ..... 5/9 R, 9 B, 59 B, 131, 5/460, 488

[56] References Cited

U.S. PATENT DOCUMENTS

| | | | |
|---|---|---|---|
| 1,009,442 | 11/1911 | Schwab . | |
| 1,466,711 | 9/1923 | Glass . | |
| 2,620,491 | 12/1952 | Allport | 5/131 |
| 2,698,445 | 1/1955 | More . | |
| 2,774,976 | 12/1956 | Ross | 5/9 R |
| 3,311,932 | 4/1967 | Ahola | 5/9 R |
| 3,693,199 | 9/1972 | Winterhur | 5/9 X |

*Primary Examiner*—Michael F. Trettel

*Attorney, Agent, or Firm*—William D. Hall

[57] ABSTRACT

A bed having upper and lower bunks. In order to make it easy to "make" the bed the upper bunk can be moved sidewise and then tilted to give a person desiring to make the bed easy access to the upper bunk. The axis about which the upper bunk is tilted may be selected to enable the tilted bunk to be higher or lower as desired. The movement of the bunk is provided by cam surfaces on the frame of the bed and cam followers on the mattress trays of the upper bunk. One set of cam followers act as a pivot to enable the rotation of the upper bunk. Locks are provided to hold the mattress tray in either its normal position or its tilted position.

19 Claims, 3 Drawing Sheets

FIG. 1
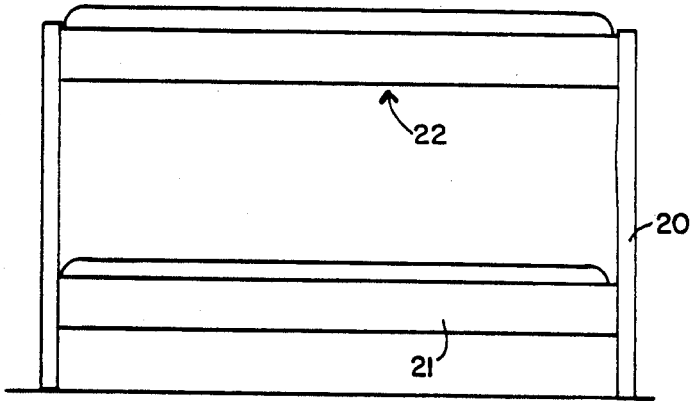
FIG. 3
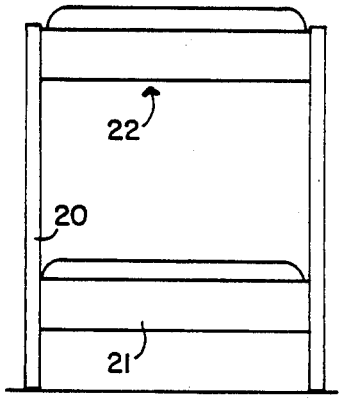
FIG 2
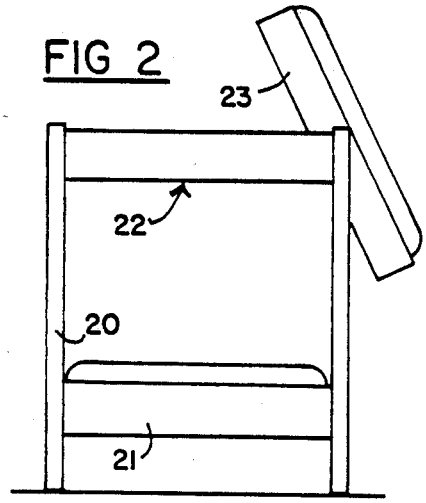
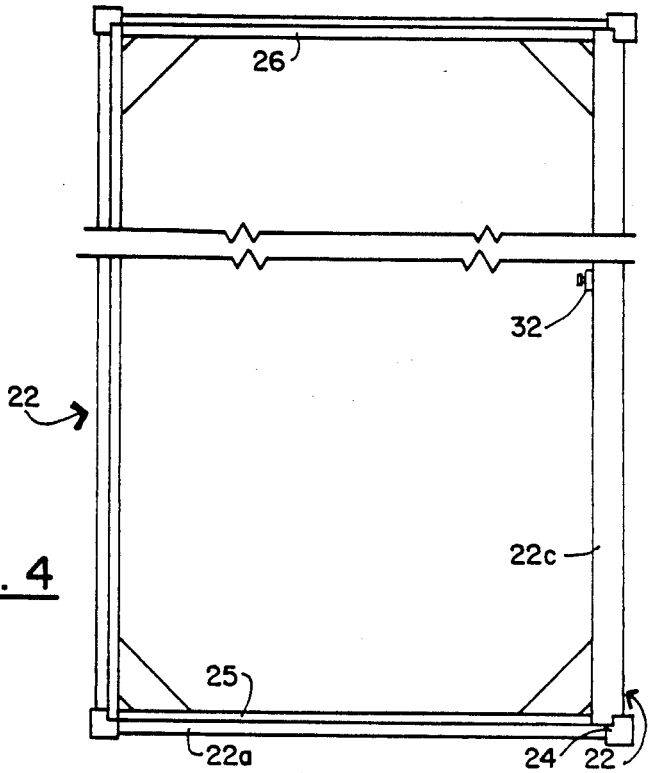
FIG. 4

50
50

50
50
55
22c
23
22a
56

27a
55
56

50
51
51
51

22a
46
47
48
44
45
43

65
66
63
22a
62
61
60
32
64

65
66
63
22a
62
61
60
32
64

65
66
63
22a
62
61
60
32
64

BED MOVABLE TO PLURAL POSITIONS

BACKGROUND OF THE INVENTION

Convertible beds are well known. For example, U.S. Pat. No. 3,311,932 shows a bed with upper and lower bunks wherein the upper bunk may be repositioned to form the back of a settee. The repositioning of the upper bunk does not, however, place it in a position in which it is easier to make the bed.

When a bed is more than two or three feet above the floor it becomes difficult to change the sheets, blankets, etc. This is true for beds having upper and lower bunks. It is difficult to change the sheets, blankets, etc., or to "make" the upper bunk of the bed. The convertible beds of the prior art do not solve this problem.

SUMMARY OF THE INVENTION

The present invention provides a mattress tray mounted for horizontal movement to a position at which it can then be tilted to a convenient angle for "making" the bed. In one example, I apply the invention to a bed having upper and lower bunks mounted on a frame. The upper bunk is too high to permit a person to "make" the bed easily.

To carry out the invention the mattress tray of the upper bunk is guided by pins moving in cam boards so that the mattress tray can move horizontally until about half of it overhangs the floor at which point the mattress tray can be rotated to a convenient angle at which a person can "make" the bed. The cam board and the support for the mattress tray may be designed to allow the mattress tray to be lowered a selected amount when it is tilted so that it is even more accessible to the person who will "make" the bed.

BRIEF DESCRIPTION OF THE DRAWINGS

FIG. 1 is a side view of a bed having upper and lower bunks.

FIG. 2 is an end view of the bed of FIG. 1 with the mattress tray of the upper bunk moved to a convenient position for making the bed.

FIG. 3 is an end view of the bed of FIG. 1.

FIG. 4 is a plan view of the frame of the upper bunk of the bed of FIGS. 1 to 3.

DETAILED DESCRIPTION OF THE INVENTION

FIGS. 1 to 3 show a bed with a frame 20, a frame 21 of the lower bunk, a frame 22 of the upper bunk, and a mattress tray 23. In FIG. 2 the mattress tray has been moved to a position in which it is easy to "make" the bed.

The mattress tray 23 supports a mattress (not shown) which fits into the mattress tray 23 and has the usual bed clothes such as sheets and blankets.

Figure 9:
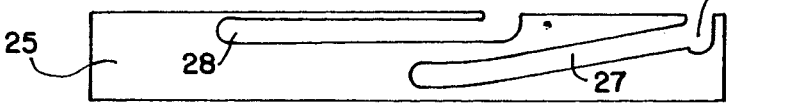
FIG. 9 is a side view of the cam board.

FIG. 4 shows the frame 22 of the upper bunk, its corner rabbets 24, the cam boards 25 and 26, and the latch 32. The cam boards 25 and 26 are shown in FIG. 9 where there are two slots or cams 27 and 28 and retaining pocket **27*a* in each cam board 25 or 26**.

Figure 7:
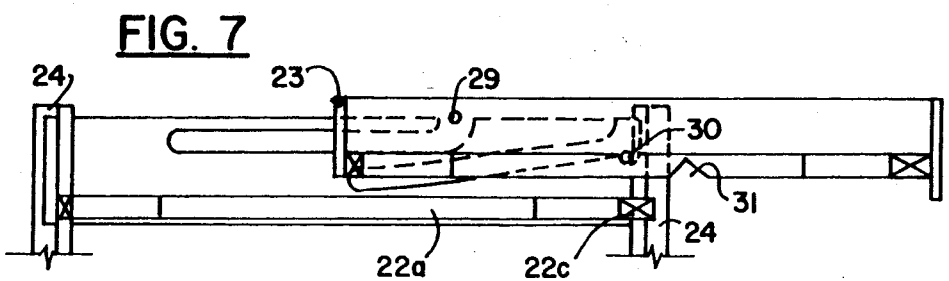
FIG. 7 is a side view similar to FIG. 6 except that the mattress tray is in its rotation position.
Figure 8:
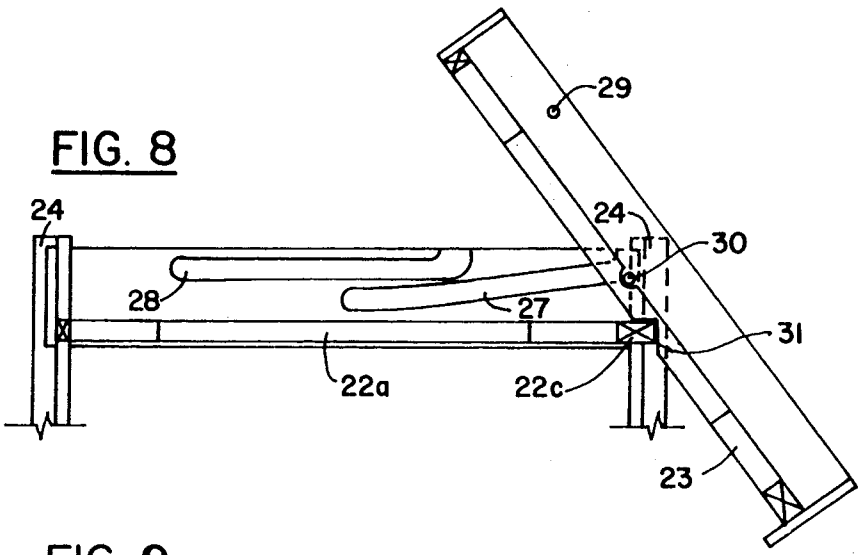
FIG. 8 is a side view similar to FIGS. 6 and 7 except that the mattress tray has been rotated to a position at which it is convenient to "make" the bed.

Extending from each of the two ends 43 and 44 of the mattress tray 23 is a pivot pin 30 and a slide pin 29, which move in cam slots 27 and 28 respectively. The cam slots 27 and 28 are so shaped that pins 29 and 30 of the mattress tray 23 can move horizontally to the right edge **22*c* of the frame of the bed as shown in FIGS. 2, 7 and 8, then dropping into retaining pocket 27*a* and then rotated about pivot pins 30 to an angle of about 45° . The mattress tray 23 defines a notch 31 which engages upper bunk frame member 22*c* (FIG. 4) when the mattress tray 23 is rotated as shown in FIG. 8. The frame member 22*c* and notch 31** hold the mattress tray firmly in a fixed position so that the bed covers may be changed.

Figure 5:
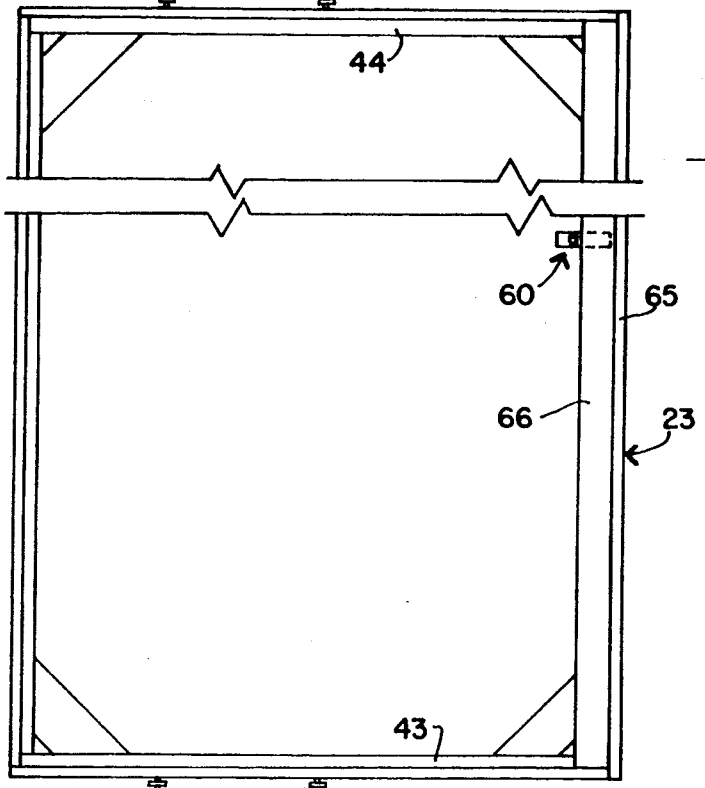
FIG. 5 is a plan view of the mattress tray of the upper bunk of FIGS. 1 to 3.
Figures 10, 11, 12, 13, 14, 15, 16, 17:
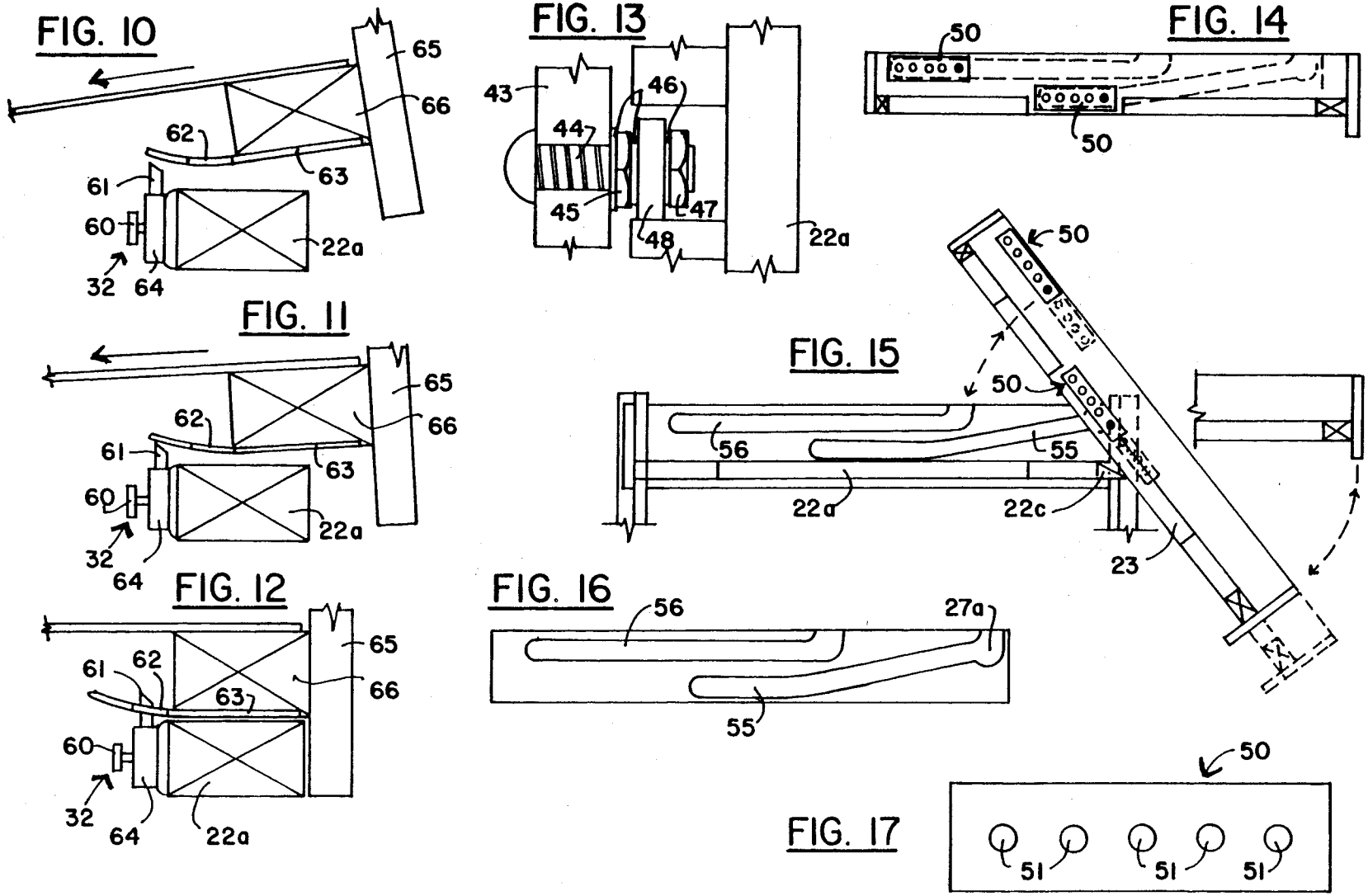
FIG. 10 is a detail view showing the mattress tray in its closing mode, and shows a latch for latching the mattress tray.
FIG. 11 is a detail view showing the mattress tray at the point of latching.
FIG. 12 is a detail view of the mattress tray in a latched position.
FIG. 13 is a detail view showing the details of the pivot pins and the slide pins that are guided by the cam boards.
FIG. 14 is an end view of a modified form of mattress tray.
FIG. 15 is a sectional end view of the upper bunk of the bed involving the modified mattress tray of FIG. 14.
FIG. 16 is a side view of the modified form of cam board used with the upper bunk of FIGS. 14 and 15.
FIG. 17 is a side view of a support for the pivot pins and slide pins for use with the modified form of FIGS. 14

FIG. 13 shows the details of one of the pivot pins 30. The two pivot pins 30 and the two slide pins 29 are all identical and hence the showing in FIG. 13 is typical of all four of these pins. The end beam 43 of the mattress tray (see FIG. 5) supports pivot pin 30 (FIG. 13). A bolt 44 and nut 45 provide support for washers 46 held in place by nut 47. A ball bearing 48 having an outer diameter of about one inch is held in place by washers 46. The outer surface of ball bearings 48 ride in the slot 27 of the cam board 25.

The modified form of the invention of FIGS. 14 to 17 provides five different positions for the pivot pins 30 and the slide pins 29 so that the mattress tray 23 may end up in any of five positions (see FIG. 15) some of which extend lower than others. This permits the person making the bed to select a position that is the most accessible to that person. For example, a tall person may desire to have the mattress tray 23 higher than a short person. Pushing the mattress tray 23 from the positions shown in FIGS. 8 and 15 to its normal "sleeping" or "closed" position is a substantial task for a weak person and the modified form of FIGS. 14 to 17 keeps the distance that tray 23 must be moved to a minimum. To accomplish the above functions I provide the support plate 50 of FIG. 17 with five holes 51 in it. Instead of the bolt 44 of FIG. 13 going through just the wall of the mattress tray it goes through that wall and a selected one of holes 51. The support plates 50 are mounted on the outside surfaces of the end walls 43 and 44 of the mattress tray 23. A modified cam board 54 of FIG. 16 has slots 55 and 56 for the pivot and slide pins of FIG. 13.

The pivot and slide pins of FIG. 13 are held in place by the selected ones of the holes 51 in support plates 50 and those pins then ride in the cam slots 55 and 56 of FIG. 16. Assuming that the pivot and slide pins are placed in the right hand holes 51 of the plates 50, the mattress tray 23 may be moved to the solid line position shown in FIG. 15. On the other hand if the holes 51, farthest to the left of plate 50 are selected, the mattress tray may be moved to the dotted line position of FIG. 15. The notch 31 is not used in FIG. 15 but the beam 22*c* has an indent or cut-away portion (not shown) so that beam 22*c* does not interfere with the mattress tray 23 being in the position shown in FIG. 15.

Figure 6:
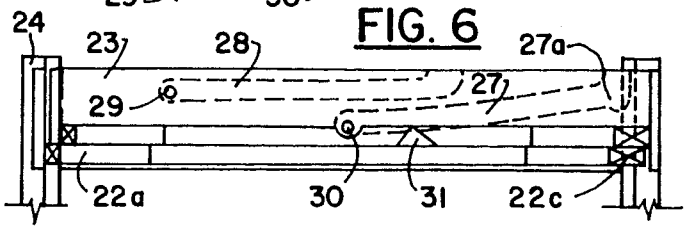
FIG. 6 is a side view showing the frame of the upper bunk, the mattress tray of the upper bunk, and the cam board, etc. The mattress tray is in closed position.

When the mattress tray 23 is in "closed" position that is, it is in a horizontal position ready for sleeping such as is shown in FIGS. 1, 3 and 6 it is locked in that position by latch 27 shown in FIGS. 4, 10, 11 and 12. The latch 27 has a push button 60 which may be pressed to release the latch 27 so that the mattress tray 23 can be moved horizontally as described above. In the event there is no hand pressure on push button 60, the bolt 61 of the latch 27 is in hole 62 in strip 63 which is securely fastened to mattress tray 23. This holds the mattress tray 23 in its "closed" or normal position as shown in FIG. 10. The body 64 of the latch 27 is securely mounted on frame member 22*a*. The strip 63 is secured to horizontal beam 66 which in turn supports the normally vertical side wall 65 of the mattress tray.

Both the mattress tray 23 (FIG. 5) and the frame 22 of FIG. 4, have four sides, a top and a bottom. The word "side" is used broadly and includes the ends as for example the end 22*a*.

I claim to have invented:

1. In a bed:

a bed surface, a frame for mounting said bed surface above a floor, said bed surface being mounted to allow sidewise movement, of said bed surface for a distance equal to about half of the width of said bed surface, and means for allowing said bed surface to swing, after it has been moved sidewise, to a position in which a person standing on the floor may make the bed.

2. In a bed as defined in claim 1:

said frame mounting said bed surface so that said surface is horizontal.

3. In a bed as defined in claim 1:

said bed surface being normally horizontal and when in said position said bed surface is at an acute angle to the vertical.

4. In a bed as defined in claim 1:

said bed surface being normally in a horizontal plane, said bed surface, when in said position, having about half of the bed surface lower than said horizontal plane.

5. In a bed as defined in claim 1:

said bed surface normally being horizontal, and latch means for holding said bed surface horizontal, said latch means including means for releasing the latch means when it is desired to move said bed surface to said position.

6. In a bed as defined in claim 1:

means for tending to hold said bed surface in said position.

7. In a bed as defined in claim 1:

said frame having four sides, said means comprising pivot means about which bed surface may rotate when the axis of rotation of said pivot means is adjacent to and parallel to one of said sides.

8. A bed as defined in claim 1, comprising:

said means being carried by said frame for supporting said bed and including first and second supports for said bed surface, guide means on said frame having first and second surfaces on which said first and second supports may ride during said sidewise movement, said first support constituting a pivot about which said bed surface may rotate after said sidewise movement has taken place.

9. A bed as defined in claim 8 wherein said second support rotates about the axis of said pivot and thereby moves away from said second surface when said bed surface rotates about said pivot following said sidewise movement.

10. A bed as defined in claim 9 comprising:

said guide means defining a slot one surface of which is said second surface, said slot defining an opening which allows said second support to move out of said slot when said bed surface is rotated following said sidewise movement.

11. In a bed:

a bed surface, a frame for mounting said bed surface above a floor, said bed surface being movable sidewise relative to said frame, and means for allowing said bed surface to swing, after it has been moved sidewise, to a position in which a person standing on the floor may make the bed, said bed surface having two ends and being supported by pivot means when in said position, said pivot means having at least two positions along said ends of said bed surface so that said bed surface may be moved to any of a plurality of different positions at least one of which is higher than another one.

12. In a bed having at least one side:

a frame for supporting the bed above a floor, a mattress tray, means for providing first and second positions for said mattress tray, the first of which positions is the normal position in which the mattress tray is located when the bed is occupied and the second position is sidewise of the first position and tilted at an angle so as to provide access to the bed by someone standing on the floor and desiring to make the bed, said means including guide means for guiding the mattress tray between said positions including means for allowing sidewise movement of said tray and then allowing tilting of said tray about an axis that is adjacent to and parallel to said side.

13. A bed as defined in claim 12 comprising latch means for latching said mattress tray in said first position.

14. A bed as defined in claim 13 comprising means for holding said mattress tray in said second position once it reaches that position.

15. A bed as defined in claim 12 comprising means cooperating with said frame and said mattress tray for holding said tray in said second position once it reaches that position.

16. A bed as defined in claim 12, comprising:

said guide means having first and second supports for said tray and projecting therefrom, and also having first and second guides for said supports respectively, said guides being mounted on said frame, each of said supports providing at least some support for said tray when said tray is in said first position, said mattress tray being movable sidewise, while said supports move in said guides, to a position where said first support is on said axis, said first support comprising pivot means which allows said tray to pivot about said axis to said second position, said second support moving away from, and free of, its complementary guide when said tray is tilted on said pivot means about said axis.

17. In a bed:

a frame for supporting the bed above a floor, a mattress tray, means for providing first and second positions for said mattress tray, the first of which positions is the normal position in which the mattress tray is located when the bed is occupied and the second position is sidewise of the first position and tilted at an angle so as to provide access to the bed by someone standing on the floor and desiring to make the bed, said means including means for guiding the mattress tray between said positions including means that permits the tilting of said tray, said means which permits the tilting of said tray comprising pivot means for guiding said mattress tray, and means providing a plurality of positions for said pivot means so that said tray will assume different elevations when said pivot means is in different ones of said plurality of positions.

18. In a bed:

upper and lower bunks and, means for supporting said upper bunk to enable it to move to either of two positions one of which is above the lower bunk and the other position is sidewise of the first position, and means which when said upper bunk is in said second position, acts as a pivot for said upper bunk about which said upper bunk may rotate without substantial further sidewise movement to a tilted position convenient for bed-making.

19. In a bed as defined in claim 18:

a frame, first and second supports for said upper bunk, said first support constituting said pivot, first and second guides on said frame for supporting said first and second supports when said upper bunk is in said one position and when said upper bunk is moved sidewise said second support being out of contact with its guide while said upper bunk is being rotated about said pivot.

* * * * *